US009038752B2

(12) United States Patent
Knull et al.

(10) Patent No.: US 9,038,752 B2
(45) Date of Patent: May 26, 2015

(54) ROTARY DRAG BIT

(75) Inventors: Craig Knull, Edmonton (CA); Jason Maw, Edmonton (CA)

(73) Assignee: Ulterra Drilling Tehcnologies, L.P., Fort Worth, TX (US)

( * ) Notice: Subject to any disclaimer, the term of this patent is extended or adjusted under 35 U.S.C. 154(b) by 692 days.

(21) Appl. No.: 13/241,795

(22) Filed: Sep. 23, 2011

(65) Prior Publication Data

US 2013/0075167 A1 Mar. 28, 2013

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/55; E21B 10/105676
USPC ..... 175/378, 412, 413, 426, 428, 430
See application file for complete search history.

(56) References Cited

U.S. PATENT DOCUMENTS

| | | | | |
|---|---|---|---|---|
| 4,624,830 | A | | 11/1986 | Barr |
| 4,911,254 | A | | 3/1990 | Keith |
| 5,238,075 | A | | 8/1993 | Keith et al. |
| 5,549,171 | A | | 8/1996 | Mensa-Wilmot et al. |
| 5,967,245 | A | | 10/1999 | Garcia et al. |
| 6,164,394 | A | * | 12/2000 | Mensa-Wilmot et al. .... 175/331 |
| 6,843,333 | B2 | | 1/2005 | Richert et al. |
| 7,040,424 | B2 | | 5/2006 | Yong et al. |
| 7,461,709 | B2 | | 12/2008 | Keshavan et al. |
| 7,686,106 | B2 | | 3/2010 | Baker et al. |
| 7,726,415 | B1 | | 6/2010 | Tipton et al. |
| 7,814,990 | B2 | | 10/2010 | Dykstra et al. |
| 8,186,460 | B2 | | 5/2012 | Garcia et al. |
| 2008/0164070 | A1 | | 7/2008 | Keshavan et al. |
| 2011/0114392 | A1 | | 5/2011 | Dykstra et al. |

* cited by examiner

*Primary Examiner* — Brad Harcourt
*Assistant Examiner* — Steven MacDonald
(74) *Attorney, Agent, or Firm* — Marc A. Hubbard; John Anderton

(57) ABSTRACT

A rotary drag bit has one or more fixed composite cutting structures formed from a plurality of discrete prefabricated cutters that abut each other along complementary side surfaces, the composite cutting structure being placed and oriented on the cutting face of the rotating body so that the composite cutting structure presents a cutting profile that does not expose any portion of the cutting face that is between or behind the composite cutting structure, with respect to the direction of travel of the composite cutting structure during boring, to the uncut earth formation as the body is rotated during boring.

16 Claims, 2 Drawing Sheets

ROTARY DRAG BIT

FIELD OF INVENTION

The invention relates generally to drag bits for earth boring.

BACKGROUND

PDC bits are a type of rotary drag bit used for boring through subterranean rock formations when drilling oil and natural gas wells. As a PDC bit is rotated, typically by rotating a drill string to which it is attached, discrete cutting structures affixed to the face of the bit drag across the bottom of the well, scraping or shearing the formation. PDC bits use cutting structures, referred to as "cutters," each having a cutting surface or wear surface comprised of a polycrystalline diamond compact (PDC), hence the designation "PDC bit."

Each cutter of a rotary drag bit is positioned and oriented on a face of the drag bit so that a portion of it, which will be referred to as its wear surface, engages the earth formation as the bit is being rotated. The cutters are spaced apart on an exterior cutting surface or face of the body of a drill bit in a fixed, predetermined pattern. The cutters are typically arrayed along each of several blades, which are raised ridges extending generally radially from the central axis of the bit, toward the periphery of the face, usually in a sweeping manner (as opposed to a straight line). The cutters along each blade present a predetermined cutting profile to the earth formation, shearing the formation as the bit rotates. Drilling fluid pumped down the drill string, into a central passageway formed in the center of the bit, and then out through ports formed in the face of the bit, both cools the cutters and helps to remove and carry cuttings from between the blades.

The shearing action of the cutters on the rotary drag bits is substantially different from the crushing action of a roller cone bit, which is another type of bit frequently used for drilling oil and gas wells. Roller cone bits are comprised of two or three cone-shaped cutters that rotate on an axis at a thirty-five degree angle to the axis of rotation of the drill bit. As the bit is rotated, the cones roll across the bottom of the hole, with the teeth crushing the rock as they pass between the cones and the formation.

PDC cutters are typically made by bonding a layer of PDC, sometimes called a crown or diamond table, to a substrate. PDC, though very hard, tends to be brittle. The substrate, while still very hard, is tougher, thus improving the impact resistance of the cutter. The substrate is typically made long enough to act as a mounting stud, with a portion of it fitting into a pocket or recess formed in the body of the bit. However, the PDC and the substrate structure can be attached to a metal mounting stud. For purposes of the following disclosure, a cutter's "body" refers to any structure that supports the PDC wear surface in the proper position and orientation.

The cutter's PDC wear surface, as mentioned, is comprised of sintered polycrystalline diamond (either natural or synthetic) exhibiting diamond-to-diamond bonding. Polycrystalline cubic boron nitride, wurtzite boron nitride, aggregated diamond nanorods (ADN) or other hard, crystalline materials are substitutes for diamond in at least some applications. A compact is made by mixing the polycrystalline material in powder form with one or more powdered metal catalysts and other materials, forming the mixture into a compact, and then sintering it using high heat and pressure or microwave heating. Sintered compacts of polycrystalline cubic boron nitride, wurtzite boron nitride, ADN and similar materials are, for the purposes of the PDC bit and cutting structures described below, equivalents to polycrystalline diamond compacts and, therefore, references to "PDC" should be construed to refer also to sintered compacts of polycrystalline diamond, cubic boron nitride, wurtzite boron nitride and similar materials unless otherwise indicated. "PDC" will also refer to sintered compacts of these materials with other materials or structure elements that might be used to improve its properties and cutting characteristics. Furthermore, PDC encompasses thermally stable varieties in which a metal catalyst has been partially or entirely removed after sintering.

Substrates for supporting the PDC wear surface or layer are made, at least in part, from cemented metal carbide, with tungsten carbide being the most common. Cemented metal carbide substrates are formed by sintering powdered metal carbide with a metal alloy binder. The composite of the PDC and the substrate can be fabricated in a number of different ways. It may also, for example, include transitional layers in which the metal carbide and diamond are mixed with other elements for improving bonding and reducing stress between the PDC and substrate.

Each PDC cutter is fabricated as a discrete piece, separate from the drill bit. Because of the processes used for fabricating them, the PDC layer and substrate typically have a cylindrical shape, with a relatively thin disk of PDC bonded to a taller or longer cylinder of substrate material. The resulting composite can be machined or milled to change its shape. However, the PDC layer and substrate are typically used in the cylindrical form in which they are made.

When the body of a cutter is affixed to the face of the drill bit, the body of the cutter occupies a recess or pocket formed in the cutting face. In some types of bits, a separate pocket or recess is formed for each cutter when the body is fabricated, and the body of the PDC cutters is then press fitted or brazed in the recess to hold it in place. However, in the case of matrix body drill bits, which are made by filling a graphite mold with hard particulate matter such as powdered tungsten, and infiltrating the particulate matter with a metal alloy that forms a matrix in which the particulate matter is suspended, the cutters could be placed in the mold before infiltration.

SUMMARY

The invention pertains generally to a rotary drag bit or other downhole tool having a rotating element that cuts earth formations using a shearing action.

Although matrix body PDC bits and hardfacing of steel body PDC bits are highly resistant to erosion, certain portions of PDC bits around the cutters tend to suffer from excessive erosion in certain soft formations containing highly abrasive material, potentially resulting in failure of cutters being supported by the portions of the body being eroded.

In one example of a downhole tool, the tool is comprised of a rotary drag bit that has one or more fixed composite cutting structures formed from a plurality of discrete, prefabricated contiguous cutters that abut each other along complementary side surfaces. The composite cutting structure is placed and oriented on the cutting face of the rotating body so that the composite cutting structure presents a cutting profile that does not have, or expose any portion of the cutting face, that is between or behind the composite cutting structure to an uncut earth formation as the body is rotated. The composite cutting structure tends to reduce or eliminate erosion of areas of the body of the bit that would otherwise be between cutters mounted on conventional PDC bits and similar downhole tools having fixed cutting structures, including eccentric reamers, hole openers, expandable reamers and impregnated rotary drill bits.

DETAILED DESCRIPTION OF EXEMPLARY EMBODIMENTS

Figure 1:
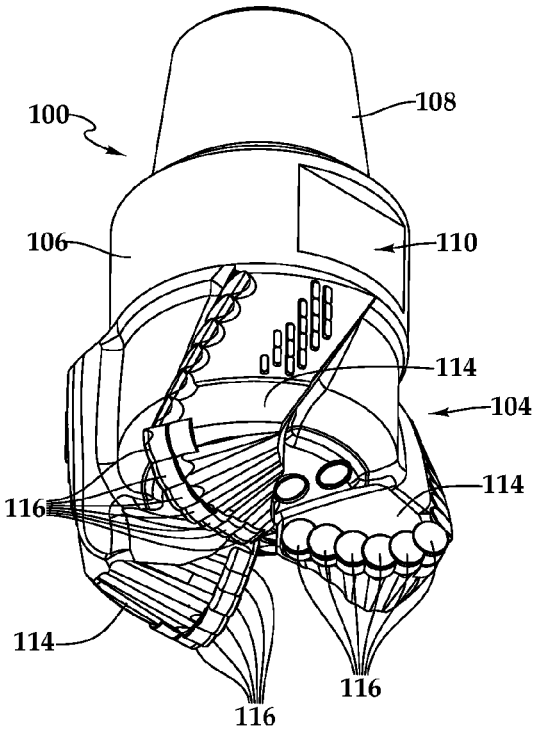
FIG. 1 is a perspective view of an example of a PDC bit.
Figure 2:
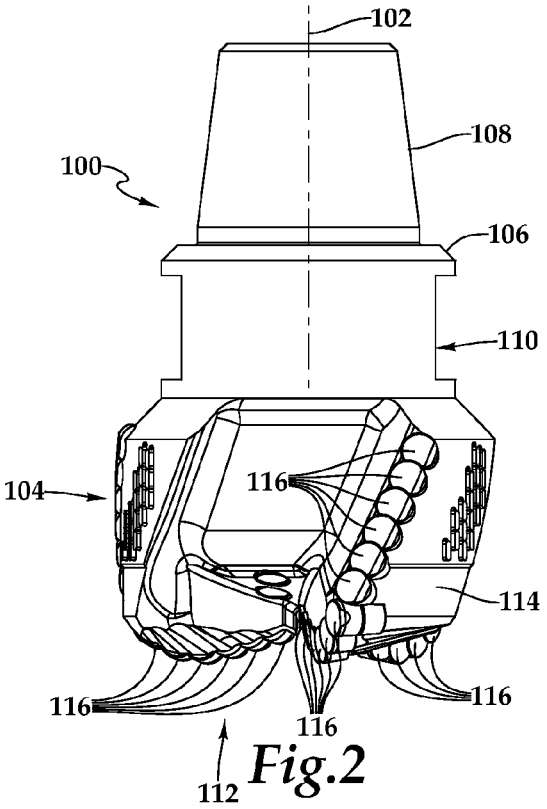
FIG. 2 is a side view of the PDC bit of FIG. 1.
Figure 3:
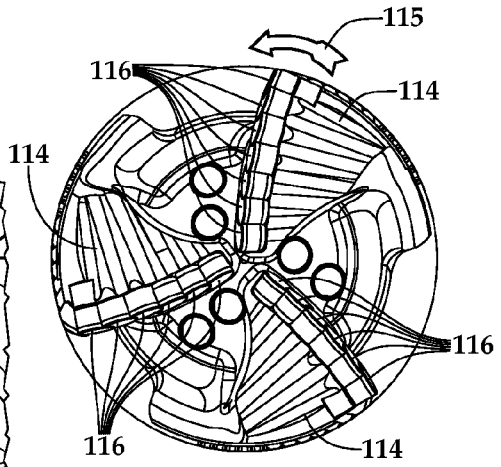
FIG. 3 is an end view of the PDC bit of FIGS. 1 and 2.

In the following description, like numbers refer to like elements.

FIGS. 1-4 illustrate an example of a downhole tool, namely a rotary drag bit with PDC cutters. Bit 100 is a representative example of rotary drag bit. It is designed to be rotated around its central axis 102. It is comprised of a bit body 104 connected to a shank 106 having a tapered threaded coupling 108 for connecting the bit to a drill string and a "bit breaker" surface 110 for cooperating with a wrench to tighten and loosen the coupling to the drill string. The exterior surface of the body intended to face generally in the direction of boring is referred to as the face of the bit and is generally designated by reference number 112. The face generally lies in a plane perpendicular to the central axis 102 of the bit. The face is best viewed in FIG. 3.

Disposed on the bit face are a plurality of raised "blades," each designated 114, that rise from the face of the bit. Each blade extends generally in a radial direction, outwardly to the periphery of the cutting face. In this example, there are three blades equally spaced around the central axis and each blade sweeps or curves backwardly in the direction of rotation indicated by arrow 115. Each blade in this particular example has a cone section 114*a*, a nose section 114*b*, a shoulder section 114*c*, and a gauge section 114*d*. However, a blade could be limited to or located on only one or more of these sections of the bit.

Figure 4:
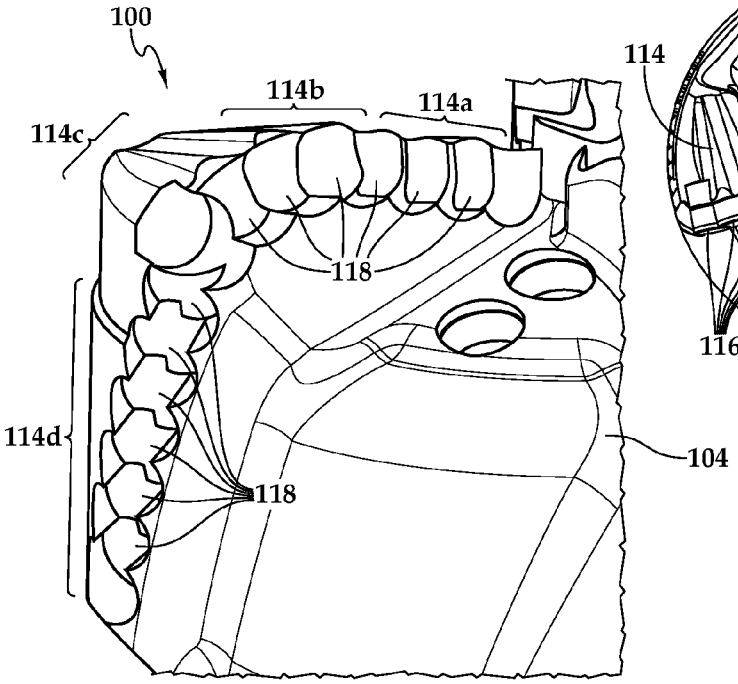
FIG. 4 is a partial, perspective view of a body of the bit of FIGS. 1-3, with the cutters removed.
Figure 5:
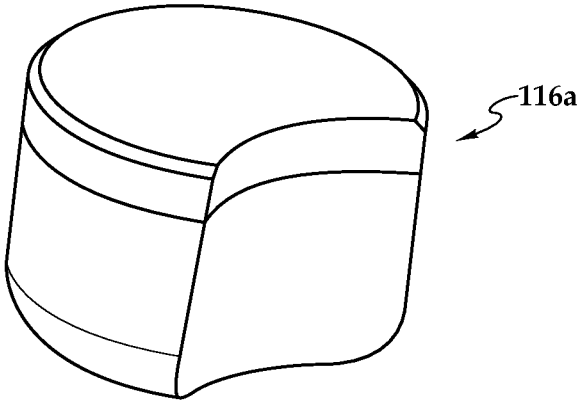
FIG. 5 is a perspective view of a PDC cutter having a pocket formed in its side that complements the outer diameter of an adjacent PDC cutter in a composite cutting structure affixed to the cutting face of the PDC bit of FIGS. 1-3.
Figure 6:
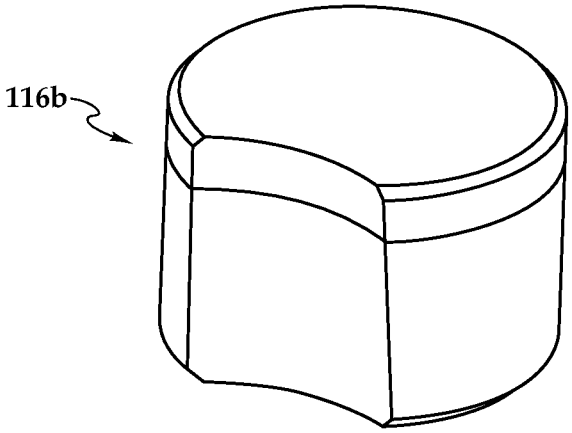
FIG. 6 is a perspective view of another example PDC cutter used in a composite cutting structure of the PDC bit of FIGS. 1-3.
Figure 7:
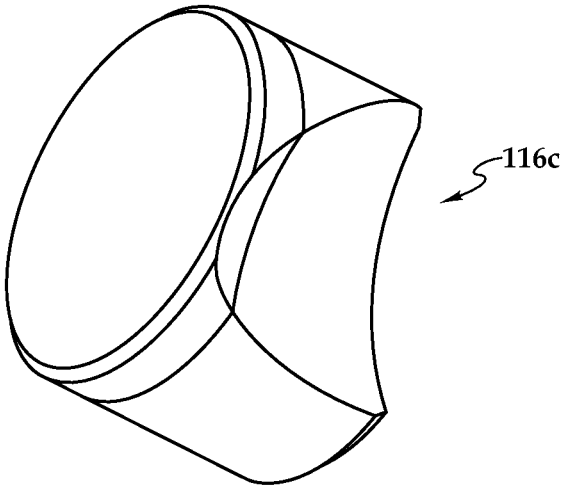
FIG. 7 is a perspective view of another example PDC used in a composite cutting structure affixed to the cutting face of the PDC bit of FIGS. 1-3.
Figure 8:
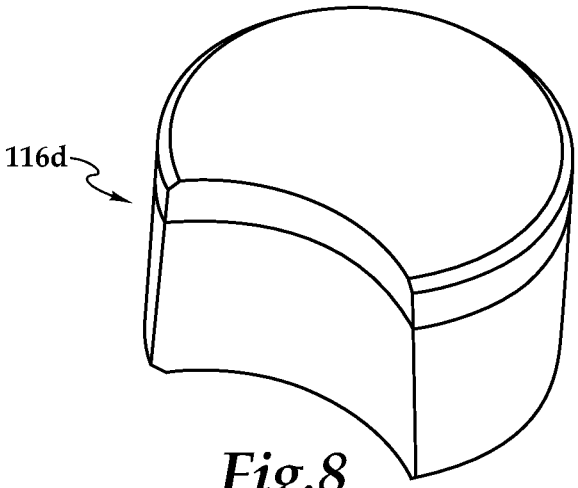
FIG. 8 is a perspective view of another example PDC cutter used in a composite cutting structure affixed to the cutting face of the PDC bit of FIGS. 1-3.

Disposed on each blade is a plurality of discrete cutting elements, or "cutters," 116. FIG. 4 omits the cutting elements. Each discrete cutting element is disposed within a recess or pocket 118. The pockets are seen only in FIG. 4. Although each cutter and pocket is referenced by the same number, the numbering does not imply that each cutter and pocket is the same. As discussed below, at least some of them are individually shaped so that they abut each other in a manner that forms a composite cutting structure that presents a continuous cutting profile when assembled on the drill bit.

The cutters are placed along the top of the forward (in the direction of intended rotation) side of the blades, facing generally in the forward direction so that the edge of the cutters' wear or cutting surface shears the earth formation when the bit is rotated about its central axis. In this example, the cutters are arrayed along blades to form a continuous cutting structure extending from the cone section of the blade to its nose section, around its shoulder section, and down the gauge section. The cutters arranged along the gauge section 114*d* are ground so that they do not project an edge that actively cuts the formation, thus acting primarily only as wear surfaces.

In this example, the cutters are PDC cutters, with a wear or cutting surface made of super hard, polycrystalline diamond, or the like, supported by a substrate that forms a mounting stud for placement in each pocket formed in the blade. The PDC cutters have been prefabricated, meaning that they have been sintered as a discrete PDC prior to being prepared for mounting into the bit.

As illustrated by cutters 116*a*-116*d* in FIGS. 5-8, which are representative examples of cutters used on bit 100, the cutters need not have the same shape and are likely to have different shapes along a blade because the shape of each cutter depends on the orientation and placement of the individual cutter on the blade and the shape of the blade. The PDC cutters illustrated in the figures were fabricated or sintered in a standard cylindrical shape. One cutter in each adjacent pair of cutters is cut, ground, or milled to form a concave recess or pocket with an exterior surface shape that complements the convex outer surface of the adjacent cutter when the cutters are positioned in the bit. In this example, the concave and convex surfaces are cylindrical and fit together in a complementary, interlocking manner.

In an alternate embodiment, each cutter can be fabricated in the desired shape. In yet another alternate embodiment, a cutter can be milled after it is brazed in place on a bit. For example, the innermost cutter pocket on each blade is formed. A full round cutter is then inserted into the pocket and brazed or otherwise attached to the bit. Using a plunge electrical discharge machining (EDM) tool, for example, the next pocket along the blade is formed in the blade, partially through the previously installed adjacent cutter. A full round cutter is then inserted into this second pocket and attached to the head by brazing or other method. These steps are repeated for each cutter that will be part of a continuous cutting structure. In this respect, at least one of the cutters need not be sintered or otherwise fabricated into the desired shape prior to being attached to the bit. This technique can ensure much better fit between the cutters.

Furthermore, the cutters could be sintered into a shape, or milled, cut, ground (or otherwise machined), or otherwise formed to have one or more flat surfaces that abut one another in a complementary fashion.

The cutters 116 on each blade in the example shown in the figures form a single composite or continuous cutting structure that extends the length of the blade. However, in the alternative embodiments, a continuous cutting structure can be used that does not extend the length of a blade and may be used on different parts of the bit.

A composite cutting structure that comprises two or more abutting cutters with abutting complementary surfaces avoids having a portion of the body of the face of the bit, between adjacent cutters, exposed to uncut earth formations or abrasive mud (i.e. drilling fluid) and formation slurry during rotation. In conventional designs, the body of the bit surrounds each cutter, forming finger-like projections or webbing extending between adjacent cutters. Even when cutters abut each other in conventional designs, the cutters touch only at a single point (or if positioned with parallel axes, along a line) and there still exist finger-like portions of the body that extend inwardly between the cutters that are exposed to the earth formations. When drilling certain relatively soft formations containing highly abrasive particles, the finger-like portions between the cutters can be relatively quickly eroded or abraded, leading to premature bit failures.

As can be best seen in FIG. 4, the recesses for the individual cutters do not have finger-like portions extending between adjacent cutters. A composite cutting structure with two or more cutters avoids or reduces or avoids the problem of erosion of the face, as the portion of the bit body between the cutters is not exposed to the earth formation or mud slurry during boring.

Furthermore, the cutting profile of composite cutting structure comprised of two or more cutters positioned on the face of the bit in the manner shown effectively occludes, or does not expose, the portion of the face immediately behind the composite cutting structure, protecting it from erosion. Because each blade in the illustrated example extends from near the center of the bit, the continuous composite cutting structure formed by the individual cutters 116 extending along the blade effectively presents a cutting profile for each blade that extends across the entire cross-section of the bit, with primarily only wear surfaces of the cutters engaging the uncut earth formation.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A downhole tool for boring earth formations, comprising:

a body with a cutting face, the body having a central axis around which the body is rotated for boring an earth formation; and a plurality of discrete prefabricated cutters mounted to the cutting face in a row, each of the plurality of discrete prefabricated cutters projecting outwardly from the face and positioned to present a cutting surface for engaging at least a bottom of a bore hole in an earth formation when the body is rotated on its central axis within a bore hole;

wherein at least one pair of cutters of the plurality of discrete prefabricated cutters abut each other along complementary side surfaces to form a composite cutting structure and a first of the at least one pair of cutters includes a rearward extending recess deeper at one end of the recess than the other end that receives a second of the at least one pair of cutters, the composite cutting structure presenting a cutting profile that does not expose any portion of the bit body between or behind the at least one pair of cutters to abrasion by the earth formation when the body is rotated during boring of the earth formation.

2. The downhole tool of claim 1 wherein the recess is curved transverse to a longitudinal axis of the first cutter.

3. The downhole tool of claim 1 wherein the recess is deeper at the mounting end of the cutter.

4. The downhole tool of claim 1 wherein the recess is deeper toward the outwardly facing end.

5. The downhole tool of claim 1 wherein the recess extends through a mounting end and the outwardly facing end of the cutter.

6. The downhole tool of claim 1 wherein the recess extends through a portion of the length of the cutter.

7. The downhole tool of claim 1, wherein the first of the plurality of cutters is cut, milled, ground or machined to form the recess.

8. The downhole tool of claim 1, wherein the first of the plurality of cutters is processed in a mold to a finished shape.

9. A rotary drill bit for earth boring, comprising:

a body with a cutting face, the body having a central axis around which the body is rotated in a predetermined direction of rotation for boring an earth formation;

the cutting face having at least two blade portions extending from the central axis to a peripheral edge of the cutting face, each of the at least two blades having a row of discrete prefabricated cutters mounted along leading edges of the blade and projecting generally outwardly in the direction of rotation, each of the cutters in each of the rows having a cutting surface positioned for engaging an earth formation when the body is rotated on its central axis within the earth formation;

wherein at least two cutters that are adjacent to each other in each of the rows of cutters abut each other along complementary side surfaces to form a composite cutting element that presents a cutting profile that does not expose any portion of the bit body cutting face between or behind the cutters to abrasion by the earth formation when the body is rotated during boring of the earth formation and a first of the at least two cutters includes a rearward extending recess deeper at one end of the recess than the other end that receives a second of the at least two cutters.

10. The rotary drill bit of claim 9, wherein each of the discrete prefabricated cutters in the rows of cutters on each of the at least two blades is prefabricated in a predetermined shape, and wherein at least one of the cutters in the pair is cut, milled, ground or machined to form a pocket that complements the shape of the other cutter in the at least one pair of cutters.

11. The rotary drill bit of claim 10, wherein the shape of each of the discrete prefabricated cutters in the rows of cutters on each of the at least two blades is cylindrical, and wherein the pocket has a complementary cylindrically shaped surface.

12. The rotary drill bit of claim 9, wherein each of the plurality of cutters is comprised of a substrate supporting a sintered polycrystalline layer forming the cutting surface.

13. The rotary drill bit of claim 12, wherein the sintered polycrystalline layer is comprised of sintered polycrystalline diamond.

14. The rotary drill bit of claim 12, wherein the substrate is comprised of a cemented metal carbide.

15. The drill bit of claim 9, wherein each row of cutters extends beyond the peripheral edge of the cutting face and down a gauge surface on the side of the body.

16. A downhole tool for boring earth formations comprising:

a body with a cutting face, the body having a central axis around which the body is rotated for boring a bore hole; and a plurality of cutters mounted to the cutting face, each said cutter having a first end surface secured against the body, an opposite second end surface exposed and defining a cutting surface for engaging a surface of the bore hole, and a side surface extending between the first end surface and the second end surface, the side surface conforming substantially to a cylindrical configuration about a central axis, and at least one of said cutters having a recess in the side surface to receive therein an adjacent one of said cutters, the recess extending from the first end surface to the second end surface, and the recess being closer to the central axis at one of the end surfaces than at the other of the end surfaces.

* * * * *